US007614366B2

(12) United States Patent
Arnold et al.

(10) Patent No.: US 7,614,366 B2
(45) Date of Patent: Nov. 10, 2009

(54) HIGH EFFICIENCY WATER HEATER

(76) Inventors: George R. Arnold, 20009 Hope Dr., Sutherland, VA (US) 23885; Donald E. Woollen, 12141 - 76th St., Largo, FL (US) 33773

( * ) Notice: Subject to any disclaimer, the term of this patent is extended or adjusted under 35 U.S.C. 154(b) by 191 days.

(21) Appl. No.: 11/678,700

(22) Filed: Mar. 16, 2007

(65) Prior Publication Data

US 2008/0223313 A1 Sep. 18, 2008

(51) Int. Cl.
*F24H 1/48* (2006.01)

(52) U.S. Cl. ..... 122/18.1; 126/367.1; 126/368.1

(58) Field of Classification Search ..... 122/18.1, 122/15.1, 18.3, 18.31, 136 R; 126/344, 367.1, 126/368.1, 381.1, 382.1, 350.1, 357.1
See application file for complete search history.

(56) References Cited

U.S. PATENT DOCUMENTS

| | | | | | |
|---|---|---|---|---|---|
| 2,232,366 | A | | 2/1941 | Chappell | |
| 2,794,426 | A | * | 6/1957 | Lowery | 122/136 R |
| 3,159,306 | A | | 12/1964 | Lyall | |
| 3,757,745 | A | * | 9/1973 | Miller | 122/136 R |
| 4,296,799 | A | | 10/1981 | Steele | |
| 4,524,726 | A | * | 6/1985 | Bindl | 122/15.1 |
| 4,653,663 | A | | 3/1987 | Holtsclaw | |
| 4,938,204 | A | * | 7/1990 | Adams | 122/18.2 |
| 4,981,112 | A | | 1/1991 | Adams et al. | |
| 5,313,914 | A | | 5/1994 | Woollen | |
| 5,337,728 | A | * | 8/1994 | Maruyama | 122/234 |
| 5,395,230 | A | * | 3/1995 | Ferguson | 431/12 |
| 5,537,955 | A | * | 7/1996 | Wu | 122/18.1 |
| 5,666,943 | A | * | 9/1997 | Adams | 122/18.3 |
| 6,945,197 | B2 | * | 9/2005 | Ryoo | 122/15.1 |
| 7,258,080 | B2 | * | 8/2007 | Missoum et al. | 122/18.1 |
| 7,290,503 | B2 | * | 11/2007 | Missoum et al. | 122/18.1 |

* cited by examiner

*Primary Examiner*—Gregory A Wilson
(74) *Attorney, Agent, or Firm*—Larson & Larson, P.A.; Frank Liebenow

(57) ABSTRACT

An application for a method of heating water includes burning fuel to produce hot gases and heating a first mass of water with a first heat exchanger coupled to the hot gases. Heat remaining after the hot gases pass through the first heat exchanger is used by a second heat exchanger to heat a second mass of water. The first mass of water is partially isolated from the second mass of water and the first mass of water is contained substantially within the second mass of water. The second mass of water is colder than the first mass of water and, thereby, condenses more water vapor out of the hot gases.

7 Claims, 4 Drawing Sheets

HIGH EFFICIENCY WATER HEATER

FIELD OF THE INVENTION

This invention relates to the field of gas and/or oil fired water heaters and more particularly to an efficient system for utilizing gas and/or oil combustion to heat water.

BACKGROUND OF THE INVENTION

Water heaters for commercial and home use are well known in the industry. The most common water heaters have a water tank and a series of heat exchange tubes immersed in the water. Hot gasses from the combustion of gas and/or oil are circulated through the tubes, thereby heating the tubes and transferring heat to the surrounding water. These water heaters utilize what is known thermal stacking—hot water moves toward the top of the tank. In such, the heat exchanger is located toward the bottom of the tank in the coolest water to maximize condensing. This type of design requires a tall water heater tank requiring space and not allow for multiple heaters to be stacked. Any mixing of the hot water with the cold or conduction through the tank walls will increase the temperature of the water at the bottom of the tank and reduce condensation and hence, reduce efficiency.

In general, the efficiency of the amount of heat energy delivered to the water from the combustion (hot gasses) is proportional to the difference in temperature between the water and the hot gasses. It is further proportional to the area of the heat exchange tubes—the greater the area, the higher the efficiency. For example, water that is at 55° accepts more heat from gasses that are at a particular temperature than water that is at 95°. As the water heats, more heat from the hot gasses passes out the exhaust system into the atmosphere.

To reduce the amount of wasted heat, multi-stage water heaters have been devised to increase the length, an therefore area, of the exchange tubes. For example, U.S. Pat. No. 4,938,204 to Adams which is hereby incorporated by reference. The disclosed water heater extends the length/area of heat exchange through the use of a second set of heat exchangers. In one embodiment, the second set of heat exchangers are immersed within the same hot water as the first set while in a second embodiment, each is submersed in a separate water tank, the water outflow from the tank with the second set of heat exchangers feeding the water inflow of the other water tank. In this design, the cold water in a first tank is heated by the first set of heat exchangers, and then the exhaust heat from the first set of heat exchangers passes through a second set of heat exchangers immersed within the second tank. The described embodiments have improvements in efficiency over prior water heaters, but requires two large-sized water tanks, both having an outer surface exposed to ambient air, a major factor in energy loss. Additionally, the efficiency of this heater is less than optimal because a percentage of its efficiency is in the form of trapped water vapor that, in this design, is exhausted out the flue as waste along with the other products of combustion. Furthermore, in its two-stage embodiment, two individual tanks are required, stacked one above the other, disallowing stacking in multiple water heater applications. Additionally, the lower tank cannot be used for hot water storage.

What is needed is a high efficiency water heater that effectively transfers as maximum amount of heat from the heat source to the water while reducing losses to the ambient air.

SUMMARY OF THE INVENTION

In one embodiment, a water heater is disclosed including a burner and a sealed outer tank with tubing for transferring heat from the burner into water residing in the sealed outer tank. A sealed inner tank is housed within the sealed outer tank and has tubing for transferring additional heat from the first tubing into water residing in the sealed inner tank. Cold water is supplied into the sealed inner tank and there are apertures for transferring some of the water residing in the sealed inner tank into the sealed outer tank. Hot water exits from the sealed outer tank to a hot water output pipe.

In another embodiment, a method of heating water is disclosed including burning fuel to produce hot gases and heating a first mass of water with a first heat exchanger that is coupled to receive the hot gases. Heat remaining after the hot gases pass through the first heat exchanger is used to heat a second mass of water. The first mass of water is partially isolated from the second mass of water and the first mass of water is contained substantially within the second mass of water.

In another embodiment, a water heater is disclosed including a sealed outer tank that has a cold water inlet aperture, a hot water outlet aperture, a heat input aperture, intermediate hot gas output apertures, an intermediate hot gas input aperture and exhaust apertures. A source of heat is connected to the heat input aperture and consequently to a firing chamber within the sealed outer tank. Heat exchange tubes are coupled at a first end to a second end area of the firing chamber and coupled at a second end to the plurality of intermediate hot gas output apertures. A heat transfer chamber is coupled at a first end to the intermediate hot gas input aperture and coupled at the second end to the first end of a second plurality of heat exchange tubes. The second end of the second plurality of heat exchange tubes is coupled to the exhaust apertures. A manifold with two chambers has a first chamber that passes hot gases from the intermediate hot gas output apertures to the intermediate hot gas input aperture and a second chamber that passes exhaust gases from the exhaust apertures to an exhaust coupling. A sealed inner tank encloses the heat transfer chamber and the second heat exchange tubes and is fluidly interfaced near a first end to the cold water input aperture and near a second end to at least one warm water aperture. The warm water apertures pass water from the sealed inner tank to the sealed outer tank.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
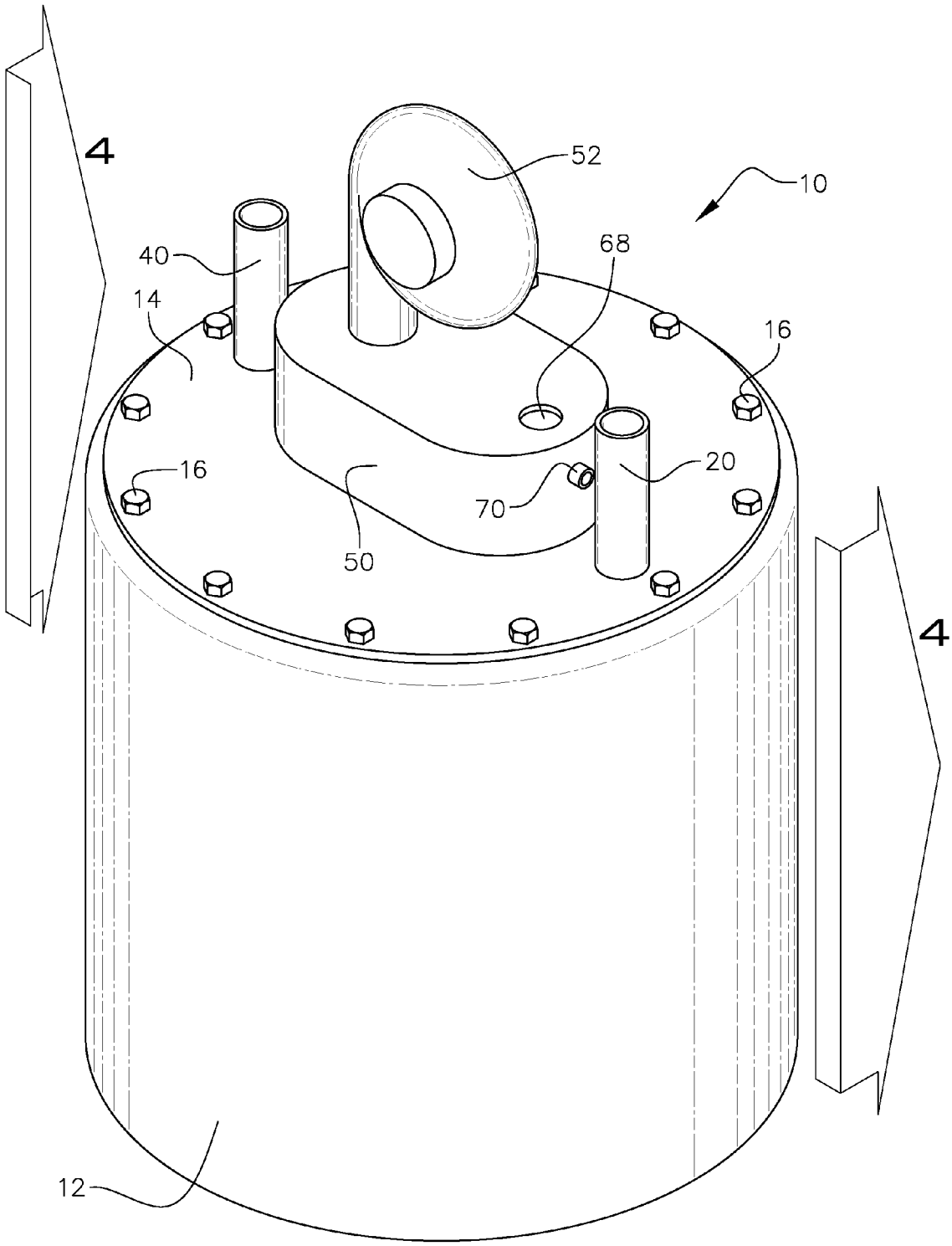
FIG. 1 illustrates an isometric view of a water heater of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a water heater of a first embodiment of the present invention is shown. The water heater 10 includes an outer tank 12 with a cover plate 14 secured to the outer tank 12 by fasteners 16. In this example, the fasteners are bolts 16 but any type of fastener is acceptable. In some embodiments the cover plate 14 is permanently affixed to the outer tank 12 by adhesive or weld. Apertures in the cover plate 14 are provided to inlet cold water, outlet hot water, input hot gases from the burner 52, outlet intermediate hot gases, inlet intermediate hot gases and outlet exhausts.

A conventional gas, oil or gas/oil burner 52 is the source of hot gasses. Cold water enters into the cold water inlet pipe 20 and hot water exits out of the hot water outlet pipe 40. Exhaust gases exit through an exhaust 68 which is normally connected to a chimney or other vent. Because of humidity in the hot gases condensing when contacting the colder heat exchange jackets, a condensation drain 70 is provided in some embodiments. Hot gases are routed through the heat exchanger then out the exhaust.

Figure 2:
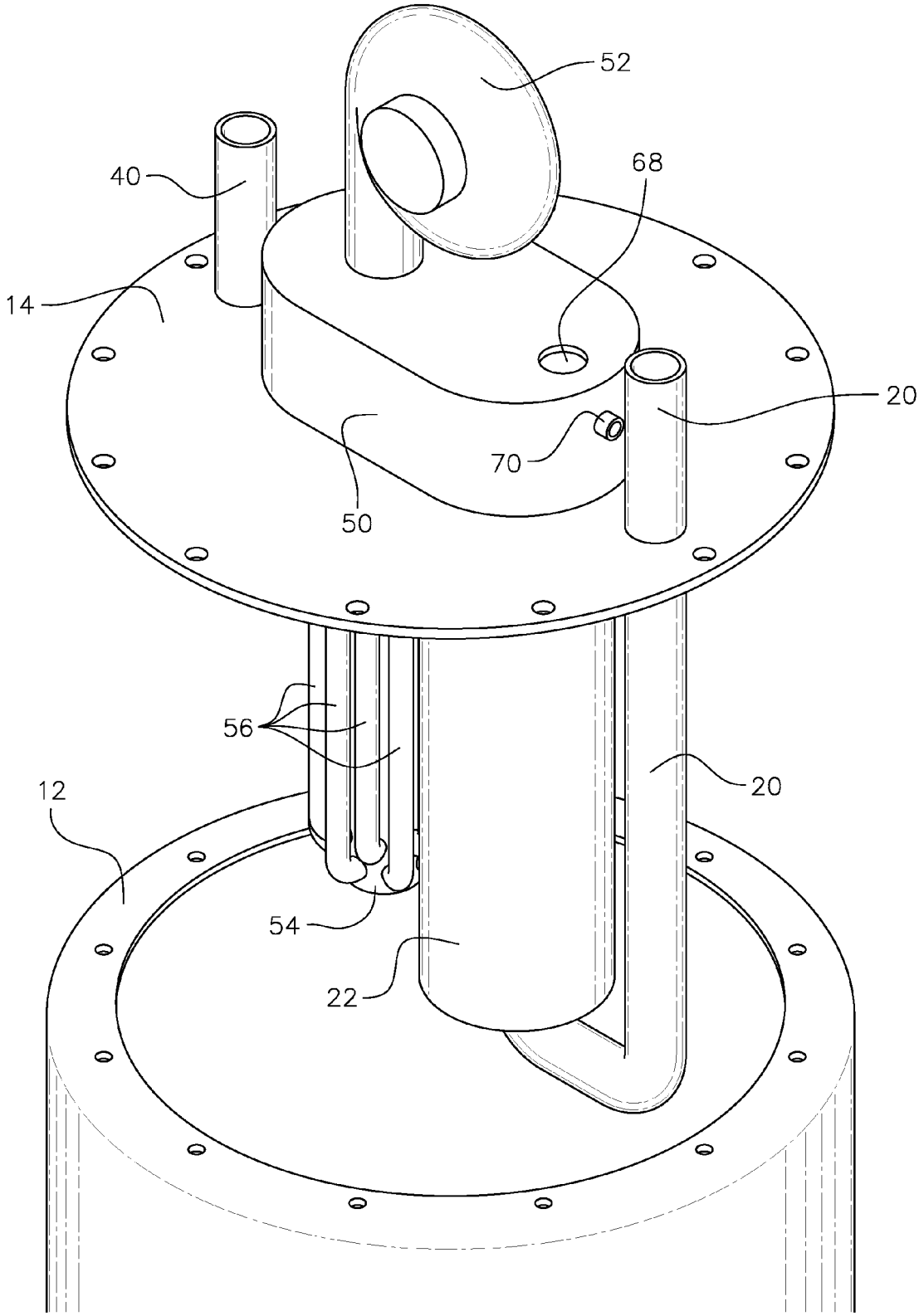
FIG. 2 illustrates an isometric view of a water heater of a first embodiment of the present invention showing internal plumbing.

Referring to FIG. 2, an isometric view of a water heater of a first embodiment of the present invention showing internal plumbing is shown. In this view, the cold water inlet pipe 20 connects to the inner condensing chamber jacket 22 and the bottom of the firing chamber 54 and first set of heat exchange tubes 56 are visible. Cold water enters through the cold water inlet pipe 20 and into the inner condensing chamber jacket 22 where it is pre-heated as will be shown in FIG. 4.

Figure 3:
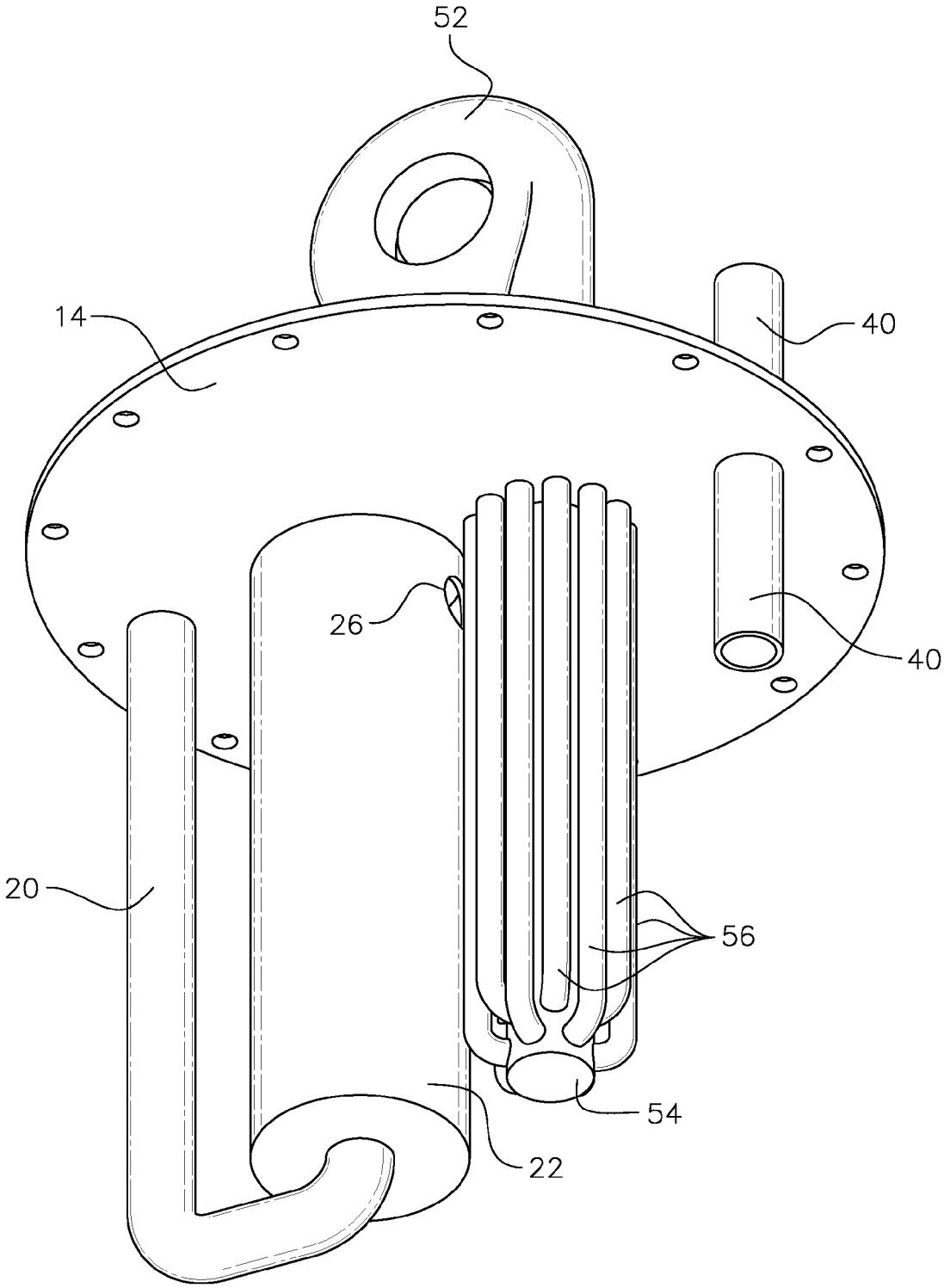
FIG. 3 illustrates a second isometric view of a water heater of a first embodiment of the present invention showing internal plumbing.

Referring to FIG. 3, a second isometric view of a water heater of a first embodiment of the present invention showing internal plumbing is shown. The pre-heated water exits the condensing chamber jacket 22 through one or more interface ports 26 into the outer tank 12 (not shown in FIG. 3) where it is further heated by the firing chamber 54 and heat exchange tubes 56.

Figure 4:
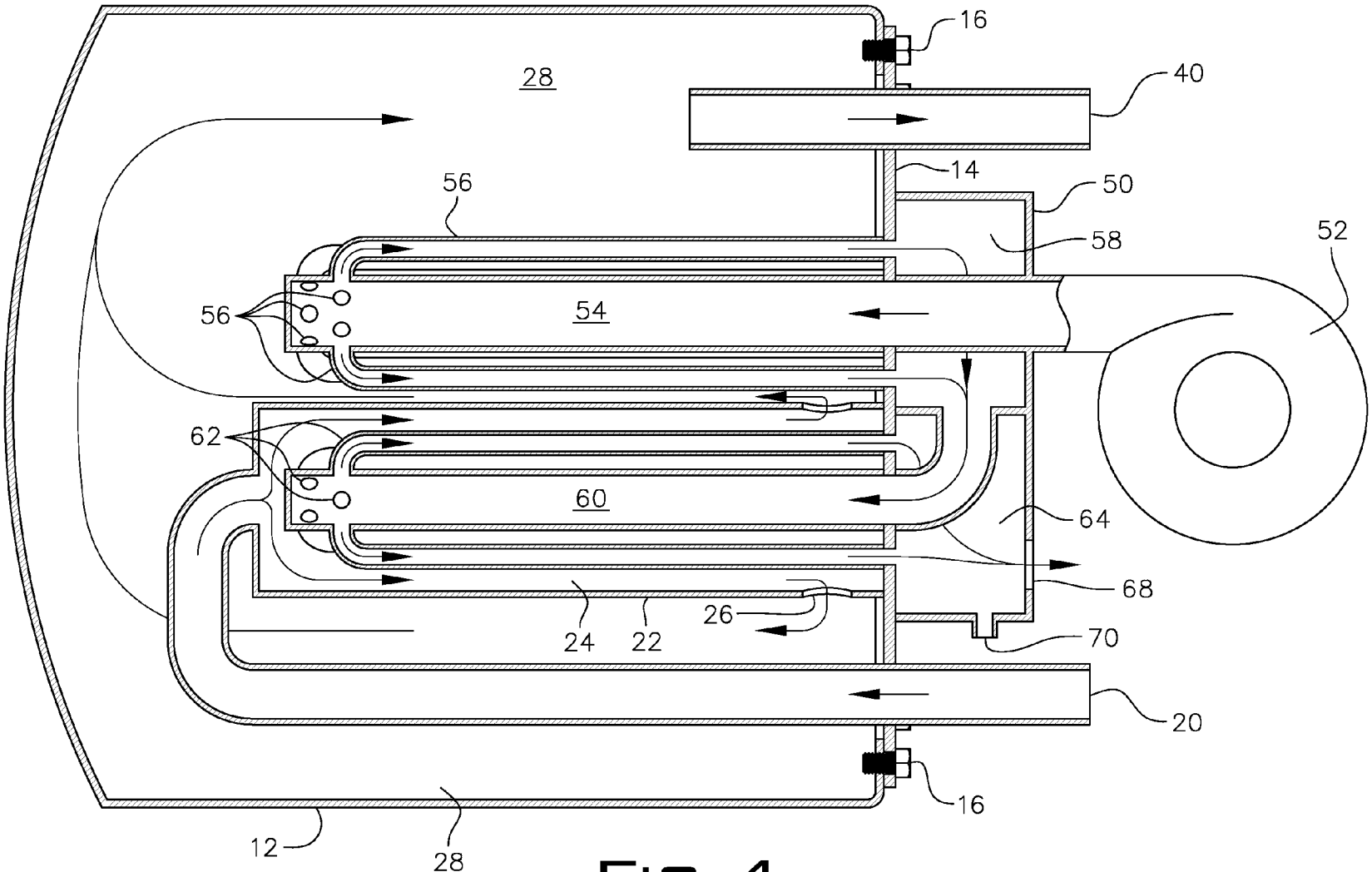
FIG. 4 illustrates a cross-section along line 4-4 of FIG. 1.

Referring to FIG. 4, a schematic view of a water heater of the present invention is shown. The burner 52 provides hot gases into the firing chamber 54 that heat the outer surface of the firing chamber 54 then exit through the heat exchanger tubes 56 which are also heated by the hot gases. The firing chamber 54 and the heat exchanger tubes 56 are immersed in water 28 within the outer tank 12 and, thereby, transfer heat to the surrounding water 28 held within the outer tank 12. The hot gases at a reduced temperature exit the heat exchanger tubes 56 into a first chamber 58 of the manifold 50 and are directed through a heat transfer chamber 60, then through a second set of heat exchange tubes 62. The hot gases (at a reduced temperature) heat the heat transfer chamber 60 and the second set of heat exchange tubes 62. The heat transfer chamber 60 and the second set of heat exchange tubes 62 are immersed in colder water 24 held within the inner condensing chamber jacket 22, thereby transferring heat to that water 24 held within the inner condensing chamber jacket 22. To make the water heater 10 more efficient, water vapor in the hot gases condenses due to the colder temperature of the water 24 held within the inner condensing chamber jacket 22. This is due to the fact that the heat transfer chamber 60 and the second set of heat exchange tubes 62 are immersed in colder water 24. Additionally, the inner condensing chamber jacket 22 is contained substantially within the outer tank 12. Therefore, heat escaping through those walls of the inner condensing chamber jacket 22 is directed into the water 28 within the outer tank.

It is anticipated that, rather than passing intermediate hot gases out of the outer tank and then back into the outer tank through the manifold, in another embodiment an equivalent apparatus passes intermediate hot gases directly within the outer tank.

After exiting the heat exchange tubes 62, the hot gases (at a further reduced temperature) exit through a second chamber 64 of the manifold 50 and exit through the exhaust coupling 68. Any condensation exits through a condensation outlet 70.

Water enters the water heater 10 through the cold water inlet 20 and into the bottom of the inner condensing chamber jacket 22, passing over the heat transfer chamber 60 and the second set of heat exchange tubes 62 before exiting through warm water apertures 26 and into the outer tank 12. The water 28 in the outer tank 12 is heated by the firing chamber 54 and the first set of heat exchange tubes 56 and the hot water 28 then exits the water heater 10 through the hot water outlet 40.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A water heater comprising:

an outer tank having a cold water inlet aperture, a hot water outlet aperture, a heat input aperture, a plurality of intermediate hot gas output apertures, an intermediate hot gas input aperture and a plurality of exhaust apertures;

a source of heat adapted to the heat input aperture;

a firing chamber within the outer tank, the firing chamber interfaced at a first end to the heat input aperture;

a plurality of heat exchange tubes operably coupled at a first end to a second end area of the firing chamber and the plurality of heat exchange tubes operably coupled at a second end to the plurality of intermediate hot gas output apertures;

a heat transfer chamber operably coupled at a first end to the intermediate hot gas input aperture and operably coupled at a second end to a first end of a second plurality of heat exchange tubes, a second end of the second plurality of heat exchange tubes operably coupled to the exhaust apertures;

a manifold having two chambers, a first manifold chamber adapted to pass hot gases from the plurality of intermediate hot gas output apertures to the intermediate hot gas input aperture and a second manifold chamber adapted to pass exhaust gases from the plurality of exhaust apertures to an exhaust coupling; and a condensing chamber jacket enclosing the heat transfer chamber and the second plurality of heat exchange tubes, the condensing chamber jacket fluidly interfaced near a first end to the cold water inlet aperture and, the condensing chamber jacket having at least one warm water aperture near a second end of the condensing chamber jacket, the warm water apertures passing preheated water from within the condensing chamber jacket into the outer tank.

2. The water heater of claim 1, wherein the cold water inlet aperture is coupled to a supply of cold water.

3. The water heater of claim 1, wherein the outer tank is sealed by a plurality of bolts.

4. The water heater of claim 1, further comprising a condensation outlet on the second manifold chamber.

5. The water heater of claim 1, wherein the outer tank comprises a tank section and a cover plate secured to the tank section by a plurality of bolts, the cover plate having the cold water inlet aperture, the hot water outlet aperture, the heat input aperture, the plurality of intermediate hot gas output apertures; the intermediate hot gas input aperture and the plurality of exhaust apertures.

6. The water heater of claim 1, wherein the outer tank comprises a tank section and a cover plate secured to the tank section by a weld, the cover plate having the cold water inlet aperture, the hot water outlet aperture, the heat input aperture, the plurality of intermediate hot gas output apertures; the intermediate hot gas input aperture and the plurality of exhaust apertures.

7. The water heater of claim 1, wherein the source of heat is a burner.

* * * * *